United States Patent [19]

Lems

[11] Patent Number: 4,628,666

[45] Date of Patent: Dec. 16, 1986

[54] METHOD FOR FORMING A STABILIZED, SUBSTANTIALLY RECTANGULAR BUNDLE OF ROUND CONTAINERS

[75] Inventor: Peter Lems, Wilmette, Ill.

[73] Assignee: Illinois Tool Works Inc., Chicago, Ill.

[21] Appl. No.: 787,481

[22] Filed: Oct. 15, 1985

[51] Int. Cl.[4] ..... B65B 21/00

[52] U.S. Cl. ..... 53/398; 53/441; 53/585

[58] Field of Search ..... 53/398, 585, 441, 556

[56] References Cited

U.S. PATENT DOCUMENTS

| | | | |
|---|---|---|---|
| 2,796,709 | 6/1957 | Bolding | 53/585 X |
| 2,933,866 | 4/1960 | Cranston | 54/585 X |
| 3,509,684 | 5/1970 | Hohl | 53/585 X |
| 3,811,243 | 5/1974 | Cunningham | 53/398 |

*Primary Examiner*—John Sipos

*Attorney, Agent, or Firm*—Thomas W. Buckman

[57] ABSTRACT

A rapid and economical method for forming a stabilized rectangular bundle of round containers is disclosed. Round containers, arranged in a spatially compact contiguous configuration, are first surrounded by a stretchable, endless band. The containers are then rearranged into a rectangular, commercially desirable but less spatially efficient configuration, causing the band to tension. Next a unitary loop matrix is positioned over one end of each of the containers, constituting the squared configuration, to stabilize or immobilize the substantially rectangular shape of the squared configuration. Positioning the unitary loop matrix on the containers causes the containers to spread apart, which causes the band to tension further. The configuration remains substantially rectangular until containers are removed from the bundle.

2 Claims, 4 Drawing Figures

METHOD FOR FORMING A STABILIZED, SUBSTANTIALLY RECTANGULAR BUNDLE OF ROUND CONTAINERS

DESCRIPTION

BACKGROUND OF THE INVENTION

The present invention is directed to a method for forming a stabilized rectangular bundle of round containers.

As used herein, the term "round container" includes, but is not limited to, cans and bottles, which are generally cylindrical in shape.

It is well known that rectangular bundles of round containers are commercially desirable for stacking and storing purposes. However, attempts to increase the production rates of rectangular bundles of round containers is an ongoing challenge. At present, the containers are gathered together and then segregated into groups. Each group is then squared into a rectangular arrangement and is next generally fastened together with a unitary loop matrix as is shown in U.S. Pat. Nos. 3,874,502 (to Weaver) or 4,018,331 (to Klygis) to form a rectangular bundle of round containers. Next, the containers may be wrapped with a covering as in shown in U.S. Pat. No. 3,286,833 (to Chadbourne), or the containers may be banded together as is shown in U.S. Pat. Nos. 4,269,308 (to Platt) or 4,269,314 (to Barrash).

It is of considerable commercial interest to increase production rates of such rectangular container bundles, yet minimize capital expenditure. The present invention provides a rapid and economical method for forming a stabilized, substantially rectangular package of containers.

SUMMARY OF THE INVENTION

The stabilized package is produced by coaxially disposing the containers into a configuration having a circumference less than that of the stabilized row-and-column array. Next a stretchable, endless band is positioned about the periphery of the resulting container configuration, preferably midway between the container ends. The band has an unstretched inner circumference less than that of the row-and-column array. Then the container configuration is squared to form the substantially rectangular row-and-column array while the positioned band is caused to be tensioned around the array by the "squaring" step. Lastly, a stabilizer means in the form of a unitary loop matrix is connected to each container of the package to stabilize the squared container configuration. Thus stabilized, the configuration remains squared until the containers are removed.

The rectangular bundle is sufficiently rigid in configuration to remain stable upon normal handling even when the rectangular bundle includes a relatively large number of containers, e.g., 24 containers per bundle. Generally, however, a rectangular bundle preferably includes four, six, nine or twelve containers.

DETAILED DESCRIPTION OF PREFERRED EMBODIMENT

Figure 1:
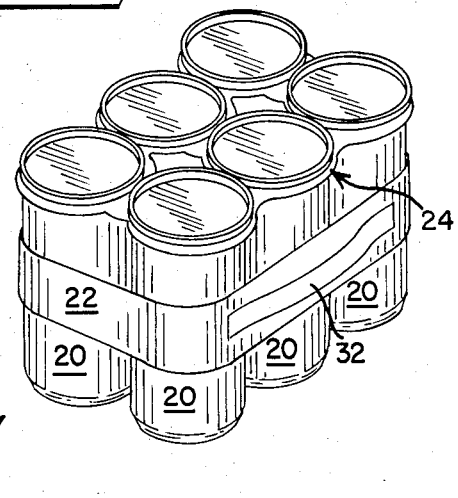
FIG. 1 is an isometric view of a stabilized container bundle formed by the method of the present invention.

Referring to FIG. 1, the stabilized container package or bundle 19 includes a 2×3 row-and-column array of containers 20 held together by a tensioned elastic band 22. The band 22 is an endless, stretchable, resilient, commercially-available plastic material, which maintains its integrity during normal handling and use. Particularly well suited for the band 22 is oriented polypropylene film of about 10 mils, preferably 3 to 5 mils, thickness. Further, other materials exhibiting suitable strength and stress retention properties can be used as well.

Figure 2:
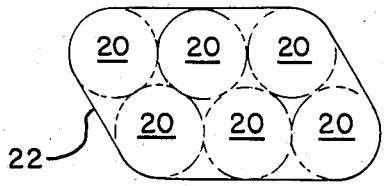
FIG. 2 is a top plan view, on a reduced scale relative to FIG. 1, of a spatially compact 2×3 configuration of containers, the containers being shown in phantom.

When containers 20 become gathered together, as commonly occurs on a conveyor belt or at a conveyor discharge area (not shown), the containers 20 form relatively closely-packed configurations of the type shown in FIG. 2. The circumference of such a relatively closely-packed contiguous configuration is less than that of a "squared" row-and-column configuration, such as that shown in FIG. 3. It has been discovered that conventional production speeds for producing the stabilized package 19 can be increased substantially without the need for significant capital investment or complex machinery when the containers are first segregated in a desired number as a relatively closely packed, co-axially disposed, set of contiguous containers 20, an endless, stretchable band 22 is positioned about the periphery of the closely-packed configuration as is shown by way of example in FIG. 2, and the banded configuration of containers is squared and stabilized.

Figure 3:
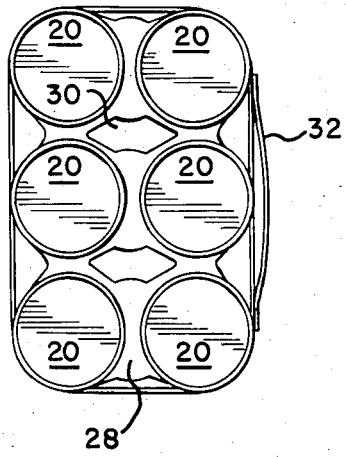
FIG. 3 is a squared top plan view, on an enlarged scale relative to FIG. 2, of the 2×3 configuration shown in FIG. 2.
Figure 4:
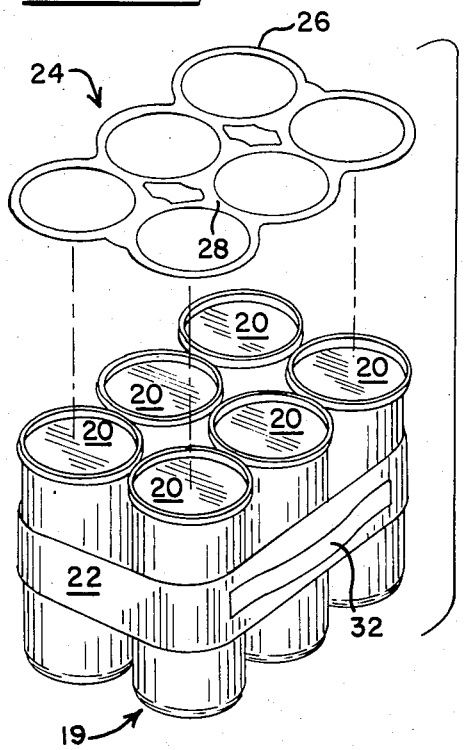
FIG. 4 is a partially exploded view of the container bundle shown in FIG. 1.

The stabilizer means is connected to each container in the package and comprises a unitary loop matrix 24, as is shown in FIG. 4. The band 22 positioned about the periphery of the closely packed configuration has an unstretched, i.e. relaxed, inner circumference less than the circumference of the rectangular bundle shown in FIG. 3.

The matrix 24 is made of a resilient, deformable, commercially available plastic sheet material and includes, as can be seen by referring to FIG. 4, a loop 26 for each one of the containers 20 in the bundle 19. Webbing 28 in the matrix 24 connects the loops 26. Generally, the unitary loop matrix 24 is formed from a single sheet of plastic such as polyethylene or polypropylene. Accordingly, the matrix 24 can include finger holes 30 for carrying the bundle 19. Alternatively, the band 22 can include an integral handle 32 for such a purpose.

The diameter of a loop 26 is slightly less than the diameter of a container 20 so that each loop 26 snugly encircles and retains a respective container 20. The loops 26 are formed in the single plastic sheet and are spaced so that the loops 26 cooperate to retain the rectangular bundle 19 in a squared row-and-column array shape, as is shown in FIG. 3. Further, the loops 26 of the matrix 24 are sufficiently resilient to maintain their integrity as a container 20 is urged into the opening of a loop 26. Loop matrices suitable for present purposes are known in the art and are described, for example in U.S. Pat. Nos. 3,874,502 to Weaver and 4,018,331 to Klygis.

When a relatively closely packed arrangement of contiguous containers 20 is encircled with the band 22, and squared, the band 22, circumscribing the containers 20, is caused to stretch and tension around the squared container arrangement. Additionally, when the squared container array is stabilized with the matrix 24, the loops 26 between the containers 20 cause the containers 20 to spread apart somewhat, thereby causing the band 20 to further tension. Thus the tension in the band 22 exerts a force against the sidewalls of the containers 20. Accordingly, band 22 is selected of sufficient width such that tension in the band 20 is distributed substantially uniformly over the side surfaces of the containers contiguous with the band and so that deformation of the containers does not occur. That is, the band is of sufficient width as not to impair the configurational integrity of individual containers 20 in the substantially rectangular bundle.

The foregoing description exemplifies preferred embodiments of the present invention. Still other variations and rearrangements of component parts are possible without departing from the spirit and scope of this invention and will readily present themselves to one skilled in the art.

I claim:

1. A method for packaging a plurality of substantially round containers in a substantially rectangular, stabilized row-and-column array, comprising:

coaxially disposing the containers into a contigous, compact configuration having a circumference less than that of the stablizied array;

positioning a stretchable, endless band about the periphery of the compact configuration, the band having an unstretched inner circumference less than that of the row-and-column array;

squaring the container configuration into a substantially rectangular row and column array thereby causing the positioned band to tension around the array; and positioning a unitary loop matrix into contact with each of the containers constituting the squared configuration so as to cause the containers to spread apart, for stabilizing the squared configuration into the substantially rectangular bundle shape.

2. The method of claim 1 wherein the unitary loop matrix comprises a resilient, deformable plastic sheet material having a container-encircling band for each container in the bundle, and webs connecting the bands.

* * * * *